United States Patent [19]

Eberling, Jr.

[11] Patent Number: 4,524,763

[45] Date of Patent: Jun. 25, 1985

[54] PORTABLE GRAVITY ASSISTED LUMBAR TRACTION DEVICE

[76] Inventor: Ernest W. Eberling, Jr., 1872 Hybiscus St., Medford, Oreg. 97501

[21] Appl. No.: 397,797

[22] Filed: Jul. 13, 1982

[51] Int. Cl.[3] ..... A68H 1/02

[52] U.S. Cl. ..... 128/75; 272/144

[58] Field of Search ..... 272/117, 135–139, 272/143, 134, 144; 128/69–75; 5/431–433

[56] References Cited

U.S. PATENT DOCUMENTS

| | | | |
|---|---|---|---|
| 1,866,397 | 7/1932 | Clewley | 5/431 |
| 3,286,708 | 11/1966 | Gartner | 128/70 |
| 3,866,914 | 2/1975 | Jackson | 272/117 X |
| 4,064,580 | 12/1977 | Ezekoye | 5/432 |
| 4,194,500 | 3/1980 | Grimaldi | 128/75 |
| 4,354,485 | 10/1982 | Safadago | 128/70 |

FOREIGN PATENT DOCUMENTS

| | | | |
|---|---|---|---|
| 587936 | 1/1978 | U.S.S.R. | 128/75 |

*Primary Examiner*—Richard J. Johnson
*Attorney, Agent, or Firm*—Neil J. Driscoll

[57] ABSTRACT

A therapeutic apparatus for use in the lumbar spine traction treatments is disclosed. The apparatus includes a conventional body harness adapted to connect to the patient's body just below the rib cage. Features of the device include first and second support frames carrying a body support board in different angular relations with the horizontal depending upon which is placed on the floor. The apparatus or device allows the patient's legs and feet to project beyond the lower edge of the support board whereby the patient may move his thigh leg segments to effect movement of the lumbar spine to the best position for traction application. Movable feet support means allow for the variable positioning of the patient's feet both horizontally and vertically accomodating the ideal degree of lumbar spine flexion in each individual patient case.

1 Claim, 8 Drawing Figures

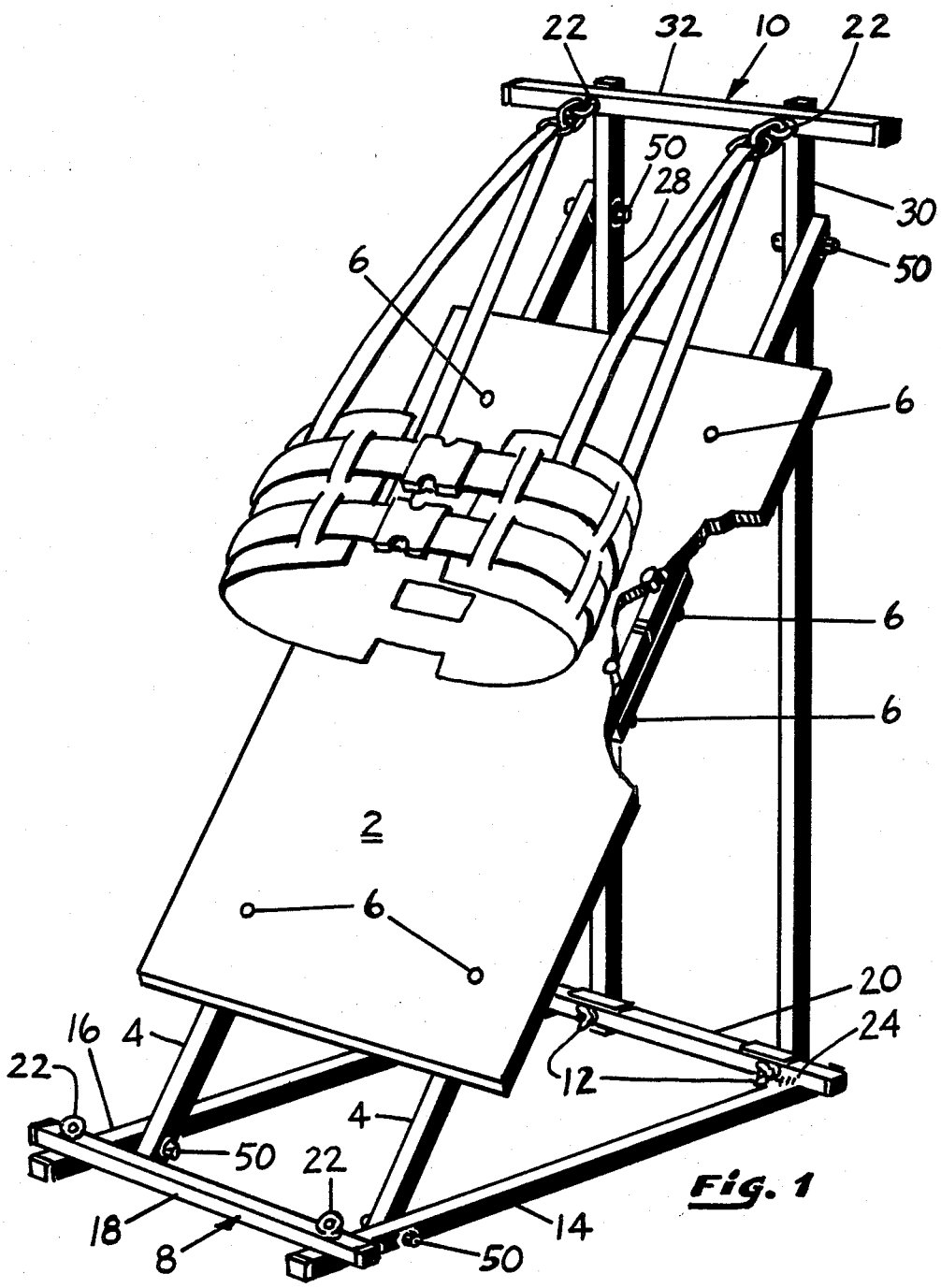
Fig. 1
Fig. 2
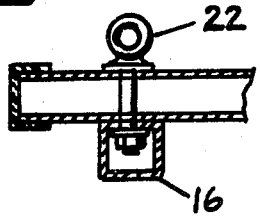
Fig. 3
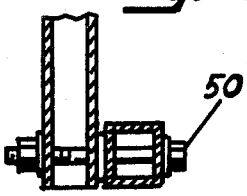
Fig. 4
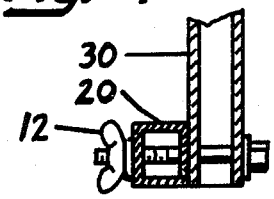

PORTABLE GRAVITY ASSISTED LUMBAR TRACTION DEVICE

BACKGROUND OF THE INVENTION

1. Field of the Invention

The invention relates to a therapeutic traction apparatus designed for self treatment. Persons afflicted with mechanical disturbances of the lumbar spine region, such as ruptured or herniated lumbar discs, can, be easy and simple body movements, control the degree of his personal discomfort during traction treatment, and, increase the efficacy of the treatment itself. The apparatus is also designed to be easily portable whereby the patient may utilize the device as his need requires in his own place of residence and may transport the apparatus in connection with his own travel.

2. Description of the Prior Art

Traction devices for applying tension to the backbone of a human being are, of course, well known. Some of these devices apply the backbone stretching forces by holding the body securely in a prone position and applying the tension forces with weights and the like secured to the body with pully systems. See, for example, U.S. Pat. No. 2,774,349 dated Dec. 18, 1956. Traction device manufacturers have also recognized that about 45% of the body weight is in the lower half of the body and have designed upper body harnesses which firmly attach to the patients body just below the rib cage. The harness is associated with a body supporting board assembly, the harness having upwardly extending shoulder straps which connect to the upper end of the board assembly. The board assembly has associated therewith a supporting frame which allows the assembly to be secured in variable angular relation with the horizontal. The board surface is smooth allowing the patient's body to slide thereon. The prior art boards support the entire body from the feet to the head. The patient is suspended on the board and the weight of the lower body, under the action of gravity, applies tension force to the patient's lumbar spine region. This teaching is illustrated by U.S. Pat. No. 4,194,500.

The traction devices of the prior art have certain characteristic inefficient features. They are physically large and cumbersome and hence confined to installations in hospitals and treatment centers where they are used in conjunction with an attendant. The attendant is available to make the necessary aparatus adjustments when the patient's physical discomfort indicates. If the patient's condition requires frequent traction treatments, it is obvious that he is confined to the geographical area of his treatment center while the condition obtains. In addition the patient must rely on the attendant being present during the treatments to provide aid in the physical manipulation of the device. The manifest disadvantages and expense such circumstances is obvious.

SUMMARY OF THE INVENTION

Consideration should be given to the subjective nature of the traction treatment of lumbar spine disorders, that is, the subjective physical variables that may apply in the treatment of each case. Sometimes it is the magnitude of the tension force that produces effective relief and recovery. Sometimes a quantitative magnitude variation over time is desirable. It may also be that frequency of traction application either with or without magnitude variation may be required.

It is known in many lumbar traction treatment applications that an immediate treatment response to the patient's subjective physical feelings yield an effective and efficient result in this treatment.

Accordingly, it is a primary object of the invention to provide a traction apparatus particularly adapted to the self variation of tension application to the lumbar spine area which allows the patient to immediately respond to the subjective feelings of relief, and, by minor physical manipulation, vary the effective tension application.

It is a further object of the invention to provide a lumbar spine traction apparatus which incudes a body supporting traction board adapted to offer surface support for a patient's body limited to the back of the head to the rear pelvic area and gravitationally suspending same.

It is still another object of the invention to provide a lumbar spine traction apparatus adapted to maintain the thigh portion of the patient's legs in variable angular relation to the long axis of the patient's spine during tension traction application.

It is yet another object of the invention to provide an apparatus of the type described wherein the patient may easily rest his feet on platforms of variable height and thereby induce movement in the lumbar segment as seen in side elevation views. The patient is thus afforded the ability to control the degree of lumbar flexion and respond immediately to feelings of discomfort thereby increasing treatment efficacy.

It is yet a further object of the invention to provide a traction apparatus of the type described which offers the patient traction application in two substantially different angular relations with the horizontal thereby providing variable tension force applications.

It is still another object of the invention to provide a traction apparatus of the type described which has supporting structure which is pivotally foldable into a generally planar configuration for transport ease.

These and other objects and advantages of the invention will become apparent in the course of the following description of a presently preferred embodiment of the invention.

BRIEF DESCRIPTION OF THE DRAWINGS

FIG. 1 is a partially fragmented perspective view of a traction device embodying the invention.

FIG. 2 is a fragmentary partially sectioned view of a typical harness connector.

FIG. 3 is a fragmentary partially sectioned view of a typical pivot connection between the board support bar and carrying frame.

FIG. 4 is a fragmentary partially sectioned view of a typical demountable bolt and wing nut connection which when removed accomodates device collapse for transport and storage.

DESCRIPTION OF THE PREFERRED EMBODIMENT

Figure 5:
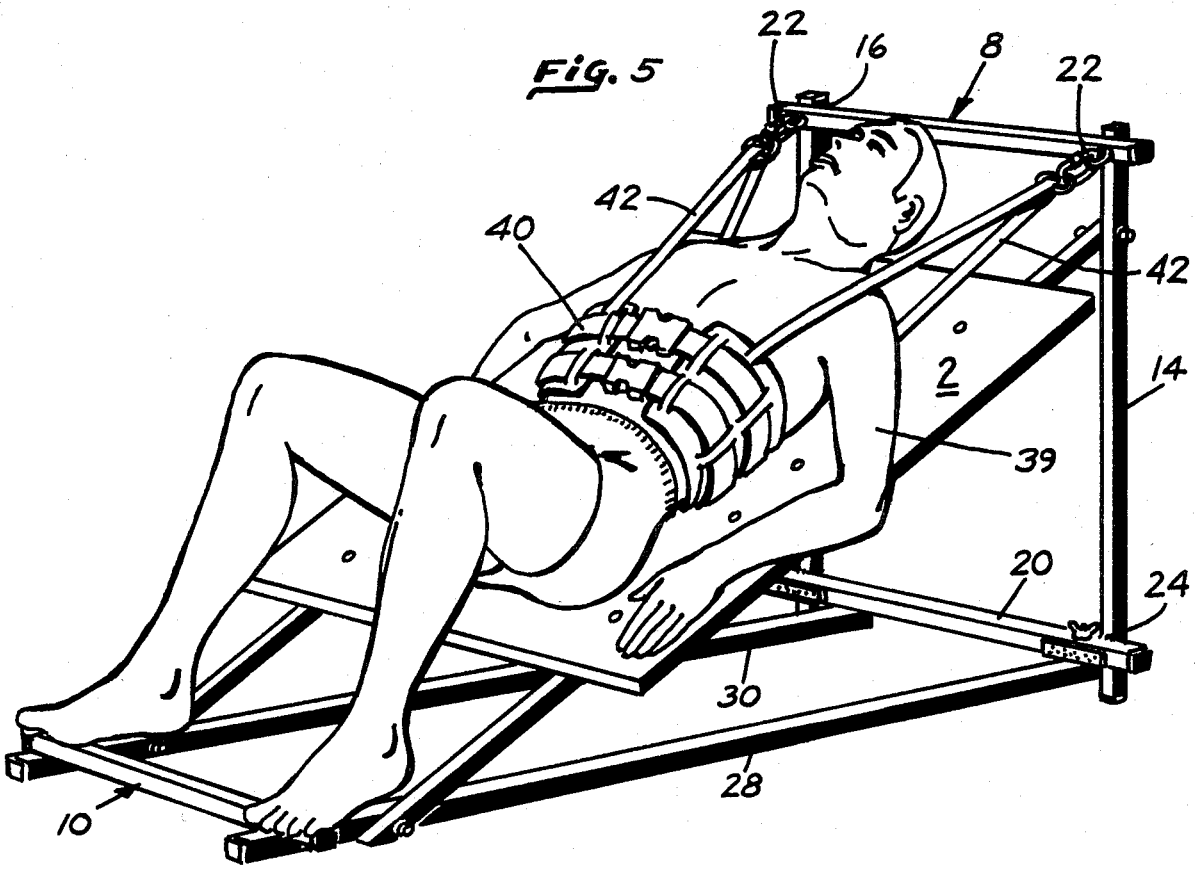
FIG. 5 is a perspective view showing a patient in place on the traction device.

Directing attention to the drawings, the lumbar traction device shown in FIG. 1 comprises a body support board 2 which is characterized by a very smooth and planar upper surface. This surface will allow the user's body to slide easily theron. Spaced members 4,4 are conventionally bolted as at 6,6 to board 2 and carry same. A pair of generally rectangular support frames, indicated generally at 8 and 10, respectively, may be detachably connected to each other by bolt and wing nuts 12,12 so that the respective planes of the frames 8 and 10 are perpendicular to each other when the traction device is assembled for use. The support frame 8 comprises channels 14 and 16 and transverse channels 18 and 20. Transverse channel 18 is connected to channels 14 and 16 by the eyebolt and nut units 22,22 (FIGS. 1 and 2) and transverse channel 20 may be welded as at 24,24 to channels 14 and 16 respectively. Rectangular support frame 10 comprises channels 28 and 30 and transverse channel 32 which is typically connected to channels 28 and 30 by the eyebolt nut units 22 as illustrated at FIG. 2. Channels 28 and 30 are also demountably bolted to channel 20 as is typically shown in FIG. 4. Thus the frames 8 and 10 form the sides of a right triangle as seen in side elevational view and the support board 2 forms a portion of the hypotenuse of the triangle. The term "hypotenuse" is here used in the generic sense of subtend and it is not critical to the invention that the frames 8 and 10 be connected to each other in exactly a right angle.

Figure 6:
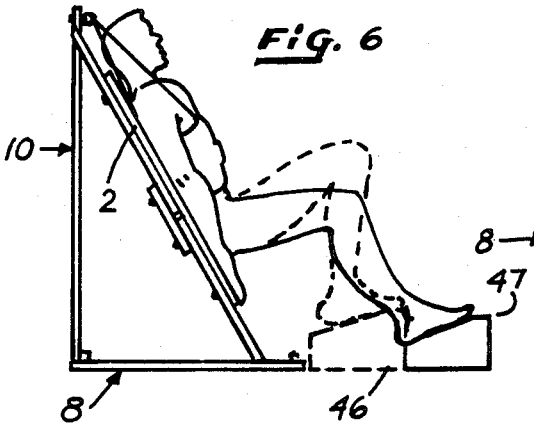
FIG. 6 is a side elevational view illustrating the device in use in the maximum tension position.
Figure 7:
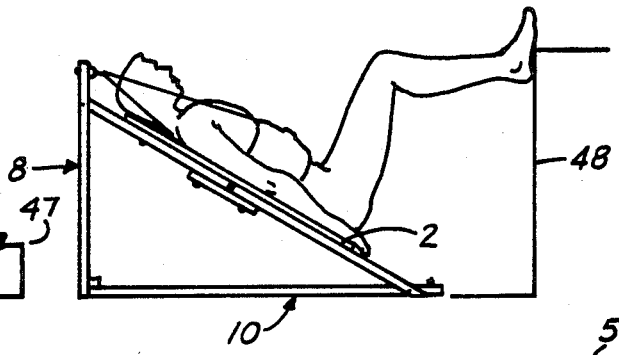
FIG. 7 is a side elevational view illustrating the device in use in the minumum tension position.
Figure 8:
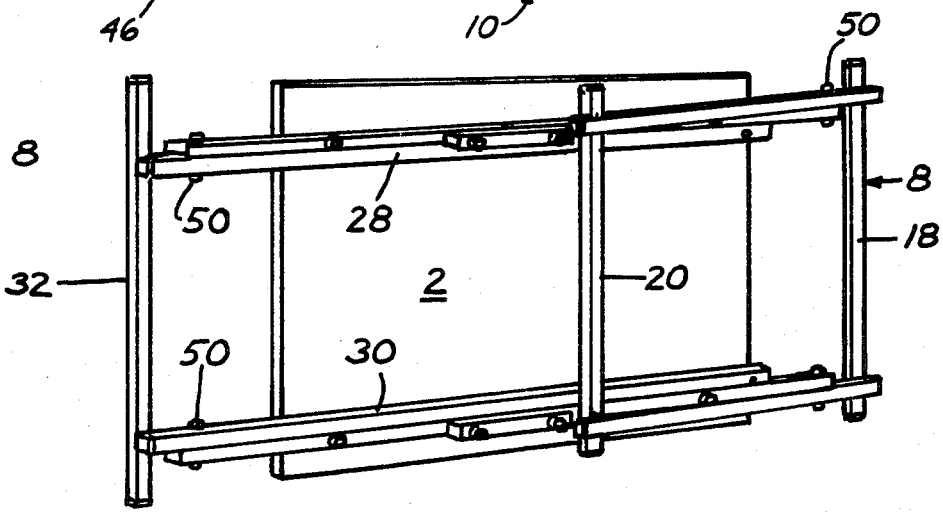
FIG. 8 is a perspective view showing the traction device in collapsed condition for transport and storage.

FIGS. 5 through 8 serve to illustrate the unique utility of the disclosed lumbar traction device. For example, in FIG. 5 with the support frame 10 engaging the floor, ie., horizontal and the support frame 8 vertically arranged, the planar surface of the board 2 forms an angle with the horizontal sustantially less than 45 degrees (FIG. 7). Alternately, with the support frame 8 engaging the floor, ie., horizontal, and the support frame 10 vertically arranged, the planar surface of the board 2 forms an angle with the horizontal sustantially greater than 45 degrees (FIG. 6). In a presently preferred embodiment the angle with the horizontal as shown in FIG. 6 is 60 degrees and the angle with the horizontal shown in FIG. 7 is 30 degrees. The operating principle here applied is to provide selectable variations of the patient support board that will substantially vary the intensity of the tension forces available for the lumbar traction operation due to gravity and thus broadening the spectrum of in use applications. This feature will hereinafter be explained in more detail.

Referring to FIG. 5, the patient 39 is provided with a conventional chest harness 40 many of which are commercially available, eg., as shown in the above referenced prior art patents. The harness 40 may be conventionally applied to the patient's body so as to tightly grip same in the area just below the rib cage. The harness 40 is provided with hanging straps 42,42 which extend upwardly over the respective shoulders of the patient to connect respectively with the eyebolts 22,22. The board 2 thus supports the patients body from the back of the head to the pelvic area with the patient's legs extending beyond the lower end of board 2.

A first useful feature of the disclosed invention relates to the new traction patient's adaptation to the traction experience. The harness 40 grips the patient's body firmly which can induce skin irritation and other discomfort. If only light tension loads are dictated, the patient may utilize the 30 degree configuration of the device as shown in FIG. 7. As the patient becomes used to the traction experience or as the need for higher tension loads are indicated, the patient may ulilize the 60 degree configuration illustrated in FIG. 6.

Another and very important useful feature of the disclosed device relates to the fact that the support board 2 only carries the patient's body from the back of the head to the rear general pelvic area. A major segment of the legs and feet protrude beyond the lower end of the support board in both use configurations. Thus the support board 2 is so hung from the frames 8 and 10 that the distance from the patient's pelvic area to the foot support area, ie., the ground, and along the hypotenuse is always less than than the patient's inseam on his ankle length trousers, hence the patient's thighs are always in angular relation to the surface of board 2. It can be readily ascertained that in both free standing or bed supine extended body condition, the lumbar spine area immediately above the pelvic bone assumes a concave configuration as seen in rear elevational view. This concavity in many treatment situations interferes with the effectiveness of the traction treatment. Utilizing the disclosed device in, for example, the configuration of FIG. 6, the patient's feet may be placed on the floor 46 so that the upper segments of his legs, ie., the thighs approach a 90 degree angular relation with the axis of his backbone. A movable foot support 47 may be placed under the feet. This additionally elevates the feet (see dotted lines FIG. 6) and further raises the thighs having the effect of tilting the lower aspect of the patient's pelvis forward, eliminating the concavity in the lumbar spine area and progressively inducing flexion at this portion of the spine to a vertical condition. The same effect may be achieved in the configuration of FIG. 7 by placing the traction device adjacent a movable vertical member indicated at 48 whereby the patient may place his feet on member 48 and adjust the postion of his lumbar spine during the traction treatment. Thus in both configurations the patient may, during tension application in the traction treatment, self adjust the pelvis and flex his lumbar spine area in relation to the direction of applied force and in direct response to his felt body requirement and thereby maximize the efficacy of the traction treatment. After movement to the best position, the patient may place a supporting towel between his pelvis and support board surface.

Still another useful feature of the disclosed device relates to its portability. The members 4,4 which carry the board 2 are in pivotal pin connection, as is typically shown at 50 in FIG. 3, with the channels 14,16, 28 and 30. Thus when the wing nuts 12 are removed, the frames 8 and 10 may be folded against the underside of board 2 (FIG. 8) for ease of transport or storage. A patient, therefore may carry his traction device with him as he travels the country and giving him geographic mobility.

Another aspect of practical utility is cost. It will be apparent to persons skilled in this field of medical treatment, that the disclosed device may be manufactured and vended at very low cost as compared to prior art units. This is important to patients involved in medical treatment in the current economy.

The disclosed invention is by the way of illustration and not limitation and may be subject to modification all within the spirit and scope thereof.

What is claimed is:

1. A therapeutic apparatus for use in gravity assisted lumbar spine traction treatments and including a body harness adapted to connect to the patient's body above the lumbar spine area, comprising first and second support frames for the apparatus connectable so that the frames are in substantially 90° angular relation to each other, a support board having a patient body support surface thereon, elongated support members carrying the support board and secured to the first and second support frames to form a triangle therewith as seen in side elevational view so that the support board and the body support surface lie within the hypotenuse of said triangle, at least one of said first and second support frames having body harness connection means thereon, said harness having means to connect to the connection means whereby same is adapted to accomodate the gravity hang of only the torso of the patient's body on the support surface, foot support means adjacent the apparatus, said foot support means and the apparatus being positioned relative to each other whereby the patient may maintain his thighs in a determined angular relation to the body support surface and may controlably vary the angular relation between the thighs and the body support surface through ninty degrees and thereby enhance the therapeutic effect of the lumbar spine traction, and said support board being dimensioned to provide body torso surface support from the patient's head to the patient's pelvic area and providing no support for the patient's thighs and lower legs whereby the patient's body is so hung by the apparatus that the distance from the patient's pelvic area to the foot support means along the hypotenuse is always substantially less than the patient's inseam.

* * * * *